US007963319B2

(12) United States Patent
Daigle et al.

(10) Patent No.: US 7,963,319 B2
(45) Date of Patent: Jun. 21, 2011

(54) DOWNHOLE CABLE GRIPPING/SHEARING DEVICE

(75) Inventors: Guy A. Daigle, Bristol, CT (US); John J. Grunbeck, Northford, CT (US)

(73) Assignee: Weatherford/LAMB, Inc., Houston, TX (US)

( * ) Notice: Subject to any disclaimer, the term of this patent is extended or adjusted under 35 U.S.C. 154(b) by 59 days.

(21) Appl. No.: 12/350,659

(22) Filed: Jan. 8, 2009

(65) Prior Publication Data

US 2010/0170675 A1 Jul. 8, 2010

(51) Int. Cl.
*E21B 29/04* (2006.01)

(52) U.S. Cl. ..... 166/54.5

(58) Field of Classification Search ..... 166/54.5, 166/55, 242.1, 377, 376, 241.5
See application file for complete search history.

(56) References Cited

U.S. PATENT DOCUMENTS 917,555 A * 4/1909 Davin ..... 166/54.5
4,250,960 A 2/1981 Chammas
4,598,769 A 7/1986 Robertson
4,738,312 A 4/1988 Wittrisch
5,435,394 A 7/1995 Robertson
6,789,627 B2 * 9/2004 Leismer ..... 166/377
6,971,449 B1 12/2005 Robertson
6,997,262 B2 * 2/2006 Palmer et al. ..... 166/298

OTHER PUBLICATIONS

Kevin L. Gray, U.S. Appl. No. 12/132,699, filed Jun. 4, 2008.

* cited by examiner

*Primary Examiner* — Kenneth Thompson
(74) *Attorney, Agent, or Firm* — Patterson & Sheridan, L.L.P.

(57) ABSTRACT

Embodiments of the present invention generally relate to methods and apparatuses for gripping and shearing a downhole cable. In one embodiment, a line cutter mandrel includes: a tubular mandrel; a pocket disposed along an outer surface of the mandrel and longitudinally coupled to the mandrel; a channel disposed through the pocket for receiving a cable; and a line cutter. The line cutter includes a blade, is operable to engage an outer surface of the cable in a gripping position, is operable to at least substantially sever the cable with the blade in a cutting position, and is operable from the gripping position to the cutting position by relative longitudinal movement between the cable and the pocket.

18 Claims, 9 Drawing Sheets

DOWNHOLE CABLE GRIPPING/SHEARING DEVICE

BACKGROUND OF THE INVENTION

1. Field of the Invention

Embodiments of the present invention generally relate to methods and apparatuses for gripping and shearing a downhole cable.

2. Description of the Related Art

FIG. 1 is a longitudinal sectional view of a subterranean wellbore 5. After the wellbore 5 has been drilled through a hydrocarbon-bearing formation, i.e., crude oil and/or natural gas, the wellbore 5 may be completed by running in a string of casing 10 which may be cemented 40 in place. Thereafter, the casing 10 may be perforated 45 to permit the fluid hydrocarbons 2 to flow into the interior of the casing 10. The hydrocarbons 2 may be transported from the production zone of the wellbore 5 through a production tubing string 15 which is concentrically disposed relative to the casing. An annulus 35 defined between the casing 10 and the production tubing 15 may be isolated from the producing zone with a packer 30. One or more blowout preventers 25 may be provided in the wellhead 20 to shut-in the wellbore 5 in an emergency.

An instrumentation sub 50 may be assembled with the production tubing 15 and in data communication with the surface via a cable 55 extending to the surface along an outer surface of the production tubing 15. The instrumentation sub 50 may include pressure sensor, a temperature sensor, and/or a flow meter which provides useful data to the surface operator in producing the wellbore. The instrumentation sub 50 may be electrical or optical and the cable 55 may be correspondingly electrical or optical. Alternatively or additionally, a hydraulically operated valve (not shown) may be assembled with the production tubing and the cable may instead be or additionally include hydraulic tubing extending to the surface for control of the valve by the surface operator.

It may become desirable to cut the production tubing 15 at a predetermined depth in the wellbore, such as after depletion of the production zone or failure of downhole equipment. Typically a tubing cutter is lowered into the production tubing 15 until the tubing cutter reaches the predetermined depth. The tubing cutter may then be operated to cut or score the production tubing. However, the tubing cutter is unable to cut the cable 55. Once the production tubing is cut or scored, the production tubing may be placed in tension from the surface (thereby severing the production tubing at the score if it is not already cut). Since the cable 55 has not been cut, the cable may also be broken. However, it is unlikely that the cable 55 will break at or near the predetermined depth. If the cable breaks at a substantial length above the predetermined depth, then a nest of cable will remain once a portion of the production tubing above the predetermined depth is removed from the wellbore, thereby obstructing future wellbore operations.

SUMMARY OF THE INVENTION

Embodiments of the present invention generally relate to methods and apparatuses for gripping and shearing a downhole cable. In one embodiment, a line cutter mandrel includes: a tubular mandrel; a pocket disposed along an outer surface of the mandrel and longitudinally coupled to the mandrel; a channel disposed through the pocket for receiving a cable; and a line cutter. The line cutter includes a blade, is operable to engage an outer surface of the cable in a gripping position, is operable to at least substantially sever the cable with the blade in a cutting position, and is operable from the gripping position to the cutting position by relative longitudinal movement between the cable and the pocket.

In another embodiment, a method of cutting a production tubing string includes running a cutting tool into the production tubing string. The production tubing string is disposed in a wellbore and includes a line cutter mandrel. The method further includes operating the cutting tool, thereby at least scoring the production tubing string; and pulling on an upper portion of the production tubing string, thereby operating a line cutter mandrel and at least substantially severing a cable or hydraulic tubing extending along an outer surface of the production tubing string.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 2:
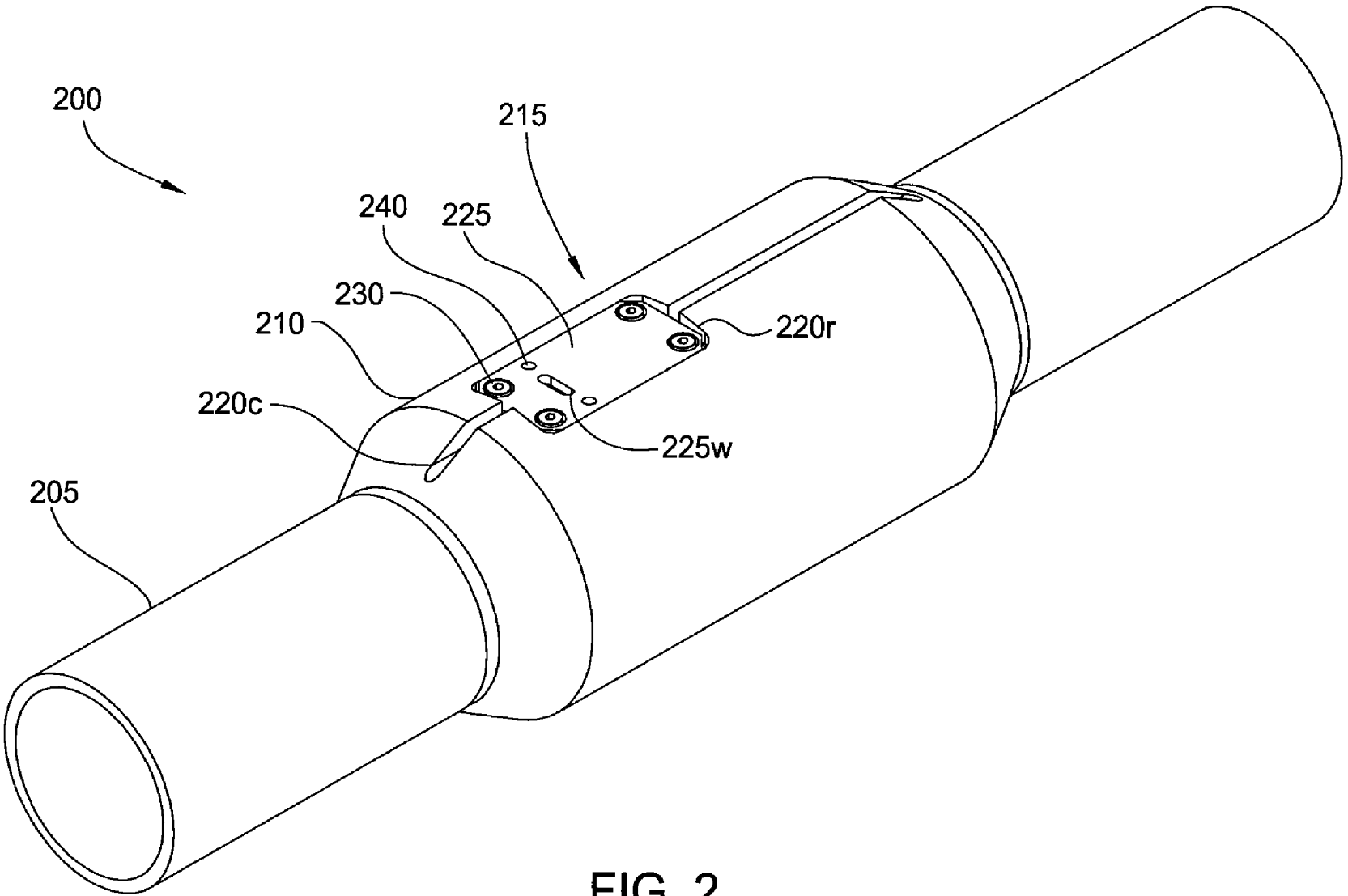
FIG. 2 is an isometric view of a line cutter mandrel, according to one embodiment of the present invention.

FIG. 2 is an isometric view of a line cutter mandrel 200, according to one embodiment of the present invention. The line cutter mandrel 200 may include a mandrel 205, a pocket 210, and one or more line cutters 215. The mandrel 205 may be tubular and have threaded longitudinal ends for assembly as part of the production tubing string 15. The mandrel 205 may be a standard joint of production tubing. The pocket 210 may be tubular and disposed along an outer surface of the mandrel 205. The pocket 210 may surround the outer surface and be longitudinally and rotationally coupled to the mandrel 205, such as by welding. Alternatively, the pocket 210 may be rotatable relative to the mandrel 205 and longitudinally coupled to the mandrel. The pocket 210 may have a channel formed longitudinally through an outer surface for receiving the cable. The pocket may also have a recess 220r formed in an outer surface for receiving the line cutter 215. The recess 220*r* may have one or more threaded holes formed in an outer surface for receiving corresponding threaded fasteners 230. The line cutter 215 may be configured so that an outer surface is flush, substantially flush, or slightly sub-flush with the pocket outer surface. Although only one line cutter 215 is shown, a plurality, such as two to six, of line cutters may be disposed circumferentially around the pocket 210.

Figure 2A:
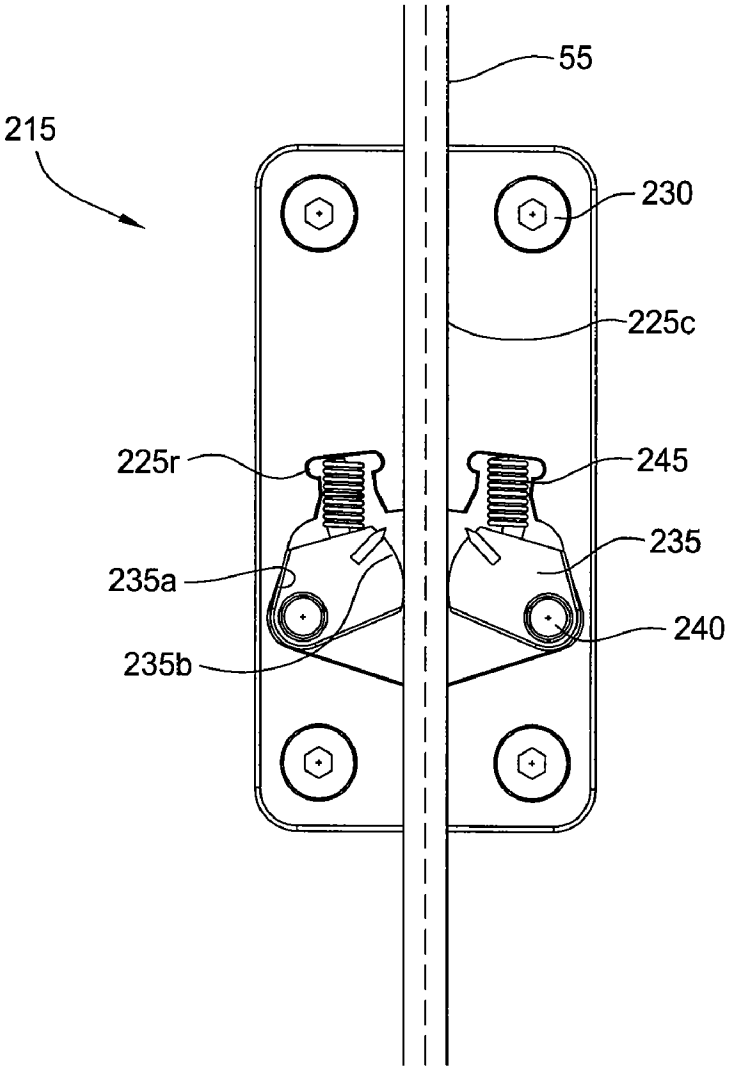
FIG. 2A is an internal view of the line cutter in a gripping position.

FIG. 2A is an internal view of the line cutter 215 in a gripping position. The line cutter 215 may include a body 225; one or more blade actuators, such as cams 235; one or more biasing members or springs, such as coil springs 245; and one or more blades 250. The body 225 may have a channel 225*c* formed longitudinally through an inner surface for receiving the cable 55. The body may have a substantially solid outer surface for enclosing the recess 220*r*, thereby retaining the cable 55. The body 225 may also have a recess 225*r* formed in an inner surface for receiving the cams 235 and the springs 245. The body may also have a window 225*w* formed therethrough for pressure equalization. Each cam 235 may be pivoted to the body 225 by a respective fastener, such as a pin 240. Each pin 240 may be disposed through a respective hole formed through the body 225, such as by a press fit. Each spring 245 may be pivoted to a respective cam 235 and the body 225. Each spring 245 may bias a respective cam 235 into the gripping position such that a first surface 235*a* of the cam is engaged with a wall of the recess 225*r*.

A second surface 235*b* of each cam 235 may be frictionally engaged with an outer surface of the cable 55, thereby longitudinally coupling each cam with the cable 55. Each blade 250 may be received by a respective opening longitudinally formed through a respective cam 235 at the second surface 235*b*. Each blade 250 made be press fit into the respective opening such that a tooth or point of the blade extends from the second surface. Each blade 250 may be made from a hard metal, alloy, ceramic, or composite, such as tungsten carbide, tool steel, or a nickel alloy. Material selection may depend on factors, such as corrosiveness of the wellbore and a hardness of a jacket of the cable 55. A hardness of the blade material may be substantially equal to, greater than, or substantially greater than a hardness of the cable jacket (or tubing wall if the cable 55 is instead hydraulic tubing as discussed above).

Figure 2B:
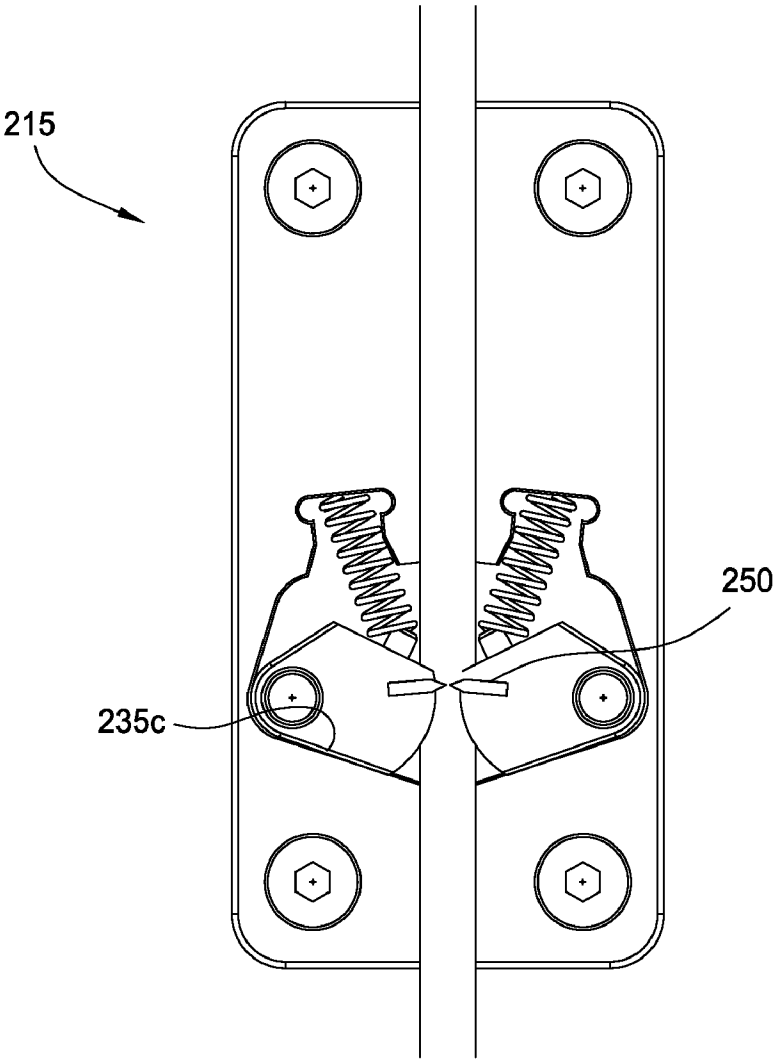
FIG. 2B is an internal view of the line cutter in the closed or cutting position.

FIG. 2B is an internal view of the line cutter 215 in the closed or cutting position. Longitudinal movement of the line cutter mandrel 200 upward, or toward the surface, relative to the cable 55 causes pivoting of the cams 235 relative to the body 225 and against the bias of the springs 245. The cams 235 pivot until a third surface 235*c* engages a wall of the recess 225*r*. As the cams 235 pivot toward the cutting position, each blade 250 engages the outer surface of the cable 55 and penetrates through a respective half of the cable until the blades are in close proximity with each other in the cutting position. Once the cutting position is reached, the cable 55 has been substantially or entirely severed. Each second cam surface 235*b* may be longitudinally curved so that each second surface remains in frictional engagement with the cable 55. Each second cam surface 235*b* may also be curved along a thickness corresponding to the curvature of the cable 55 so that the second cam surfaces substantially surround the cable in the cutting position. Each blade may be straight or substantially straight along a thickness so as to sever or substantially sever the cable 55. The cam thickness and/or blade thickness may be slightly greater than a diameter of the cable 55, such as one-eighth to one-half inch.

When running the production string 15 in the wellbore 5 with the cable 55 (and/or hydraulic tubing), the mandrel 205 and pocket 210 may be conventionally added to the production tubing string 15. The cable 55 may be fed from a spool along the production tubing string 15. The cable 55 may be pressed into the channel 225*c* and between the cams 235. The line cutter 215 may then be fastened to the pocket 210 using the fasteners 230 while placing the cable 55 in the channel 220*c*. Provision of additional line cutters 215 around the pocket 210 may be beneficial as an orientation of the line cutter 215 may be unknown due to threaded makeup of the mandrel 205 with the production tubing 15. If multiple line cutters 215 are used, then the cable 55 may be run through the line cutter in closest alignment with the existing cable path along the production tubing string 15. Alternatively, the pocket 210 may have multiple recesses and the line cutter may be fastened into the recess closest to the cable path after the mandrel 205 is added to the production tubing string 15 or, as discussed above, the pocket may be rotatable relative to the mandrel. The process may be repeated for additional cables and/or hydraulic tubing lines being run.

Figure 1:
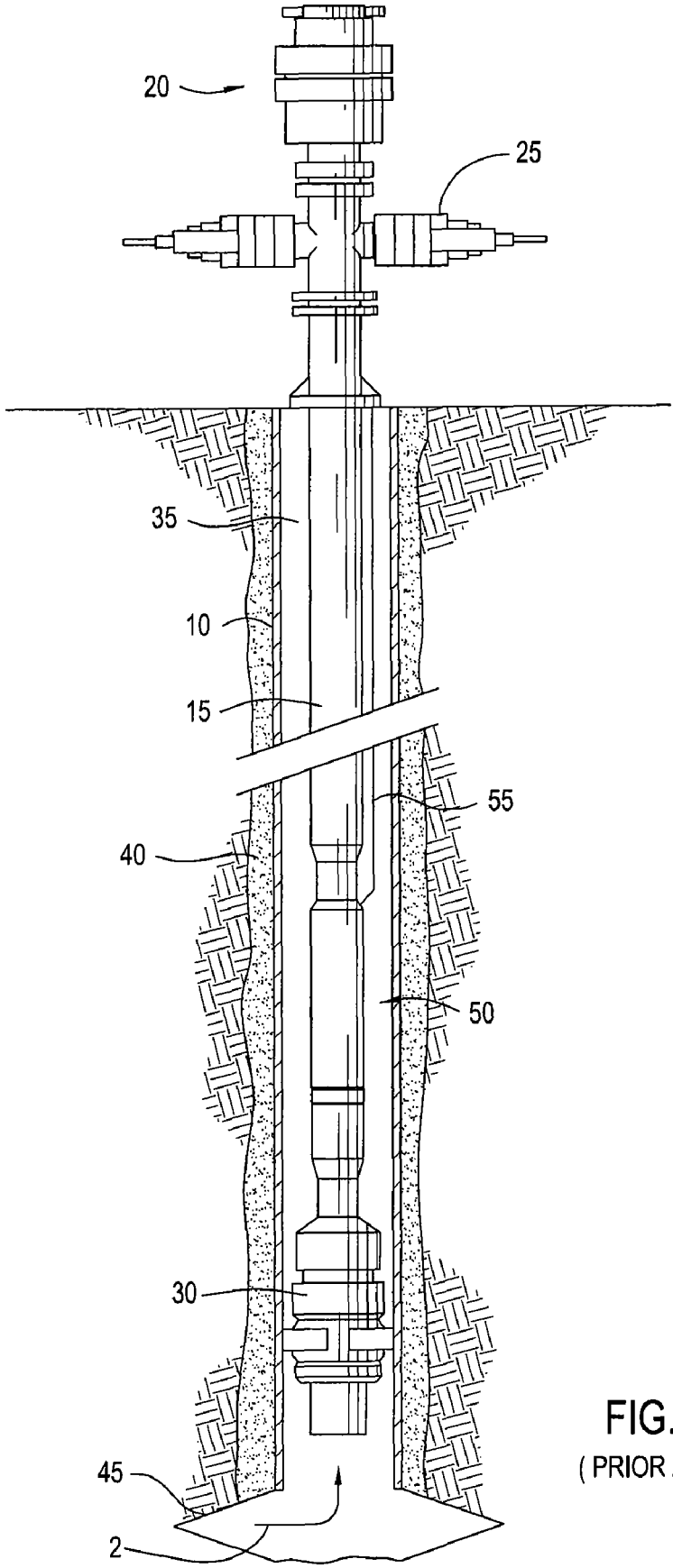
FIG. 1 ( PRIOR ART )
FIG. 1 is a longitudinal sectional view of a subterranean wellbore.

The location of the line cutter mandrel 200 in the production tubing string 15 may be proximately or distally below the planned depth where the production tubing string 15 would later be cut or scored. For example, referring to FIG. 1, the line cutter mandrel 200 may be placed proximately above the instrumentation sub 50. This placement would allow the production tubing 15 to be cut/scored at a depth almost anywhere above the instrumentation sub with the assurance that that the cable 55 would be cut below the depth of the tubing cut. If multiple tools having cables/hydraulic lines extending to the surface are deployed in the production tubing 15, then the line cutter mandrel 200 may be placed above the tool closest to the surface. Alternatively, the line cutter mandrel 200 may be at or proximately above the planned depth where the production tubing string 15 would later be cut or scored.

Additionally, a second line cutter mandrel 200*b* may be assembled with the production tubing string 15. The first line cutter mandrel 200*a* may be placed above the planned production tubing cut depth and the second line cutter mandrel below the planned depth so that the line cutter mandrels 200*a, b* straddle the planned cut depth. One of the line cutter mandrels 200*a, b* may be bladeless and the other may include the blades 250 or both of the mandrels may include the blades 250. Further, additional line cutter mandrels 200 may be spaced along the production tubing string at regular intervals, such as every 1,000 feet.

Figure 3:
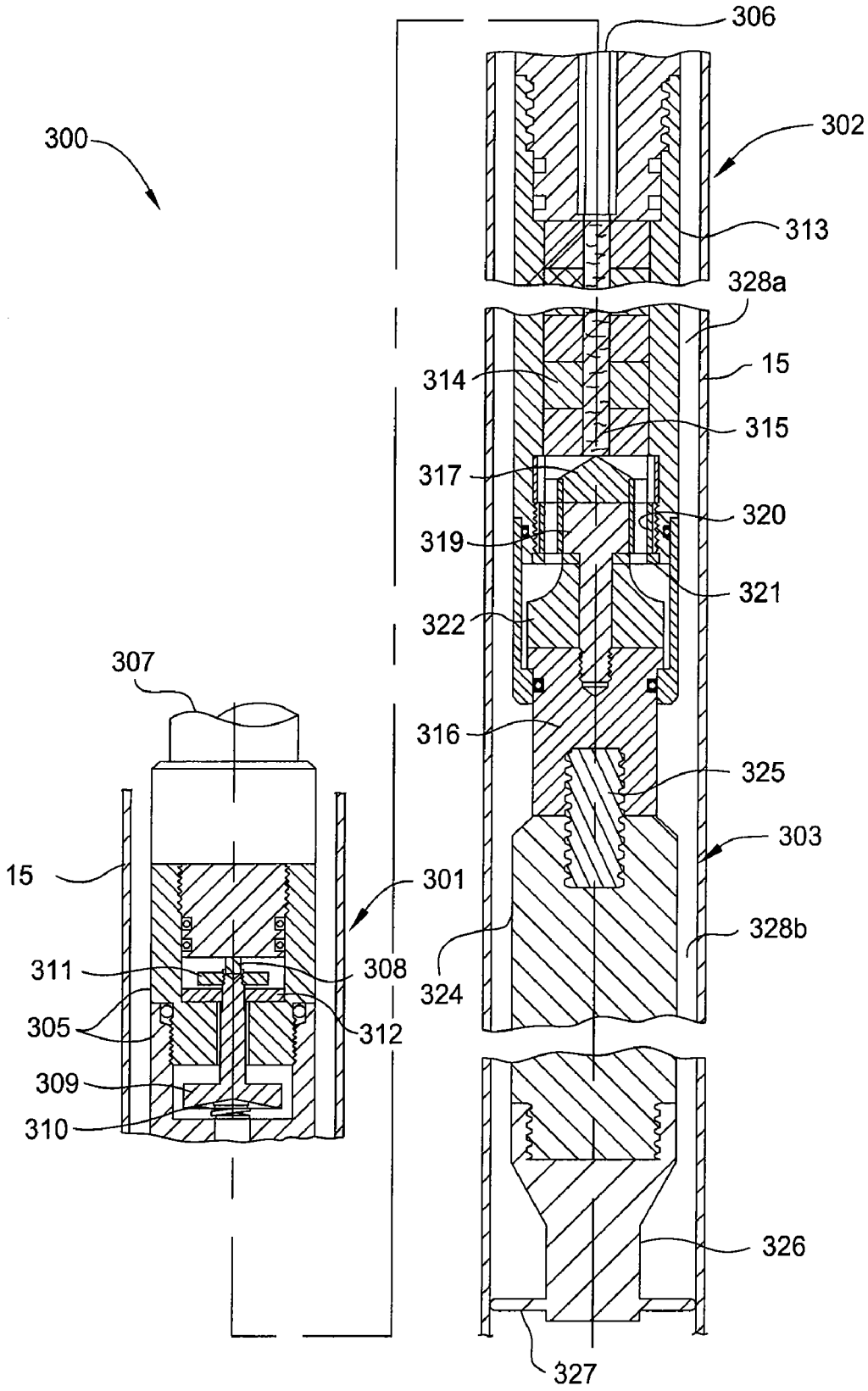
FIG. 3 is a cross section of a radial cutting torch (RCT).

FIG. 3 is a cross section of a radial cutting torch (RCT) 300. The RCT 300 may be used to score or sever the production tubing 15 by deployment from the surface with a wireline 307. The RCT 300 may include an igniter 301, a combustor 302, and an anchor 303. Igniter 301 may include a tubular housing 305 which may include an upper portion and a lower portion. The housing upper portion may have a shoulder at its lower end. The housing lower portion and may be threadedly connected to the shoulder. A passageway may be defined in the housing lower portion and may receive a squib 306. Squib 306 may be ignited by an electric current, which is carried through electric conductors leading from the earth's surface down through the wireline 307 into the housing 305. The electric current may be passed from the housing 305 to squib 306 by an electrode plug 304, a brass prong 308, a steel conductor 309 and a spring 310.

Plug 304 may be threadedly connected in the interior of upper housing with one or more O-ring seals mounted on the plug to prevent the passage of fluids between housing upper portion and lower portion. Steel conductor 309 may include a generally flat head portion facing toward squib 306 and a stem portion extending away from head portion on the side opposite of squib 306. Spring 310 may be disposed between steel conductor 309 and a shoulder on housing lower portion to urge brass prong 308 into engagement with plug 304. A nut 311 may be threadedly connected to conductor stem portion and an insulating washer 312 to prevent a short of the electric current is disposed around conductor stem portion between nut 311 and upper housing shoulder.

The combustor 302 may be threadedly connected to the lower housing. Combustor 302 may include an elongated tubular sleeve 313. The sleeve 313 may define a chamber for receiving solid combustible pyrotechnic material 314 to provide a pipe cutting flame of sufficient duration to cut or score production tubing 15. Internal threads may be formed along an inner surface of the sleeve 313. The combustible, pyrotechnic material 314 may be compressed into pellets of a generally donut configuration so as to permit stacking the housing 313 chamber. The combustible material 314 may be a mixture of a metal or alloy and a metal or alloy oxide, such as thermite. The hole in each pellet 314 may be coaxially aligned with the squib 306. Loosely packed combustible material 315, which may be the same material used in forming pellets 314, may be disposed within the holes of pellets 314 such that each pellet 314 becomes ignited from loosely packed combustible material 315 after ignition by squib 306.

A head 317 may be from heat resistant material. The head 317 may be disposed within the sleeve 313 and have a plurality of passageways, i.e., two to eight, disposed equidistant from one another around the edge, that extend longitudinally. An inner portion of the head 317 may be conical to direct the pipe cutting flame into mouths of plurality of the shield passageways. A spindle 319 may connect head 317 to sleeve 313. The spindle 319 may have threaded portion to connect to internal threads of sleeve 313. The spindle 319 may include a passageway aligned with each head passageway and lined with a liner 320 made of heat resistant material. The spindle 319 may extend downwardly away from head 317 and have a second threaded portion. A retainer 321 may lock spindle 319 to sleeve 313. Retainer 321 may be an annular member, made of heat resistant material, and define a passageway aligned with each spindle passageway. A diverter 322 may be constructed from heat resistant material to direct the pipe cutting flame from a longitudinal direction to a radial direction toward the production tubing 15. The diverter 322 may include a truncated cone-like portion disposed adjacent the retainer body 321 to form a shoulder. The diverter 322 may further include a cylindrical portion extending downwardly away from the cone-like portion. The diverter 322 may further include a passage to receive the spindle 319.

A mandrel 316 may secure the diverter 322 to retainer 321. The mandrel 316 may include a threaded passage for engaging the spindle 319. The mandrel 316 may include a shoulder formed in an outer surface. A cover 323 may prevent foreign matter from entering the diverter 322. The cover 323 may extend between the mandrel 316 and the sleeve 313. The sleeve 313 may include a recess formed in an outer surface for receiving the cover 323 so that a smooth outer surface is maintained along the RCT 300. The cover 323 may include an inwardly extending annular shoulder to engage the mandrel shoulder. An O-ring seal may be provided in the sleeve 313 recess and an O-ring seal may be provided on the mandrel 316 facing the cover shoulder.

The anchor 303 may include an elongated tubular body 324. The anchor body 324 may be threadably connected to the mandrel 316 via a threaded pin 325. The outer diameter of anchor body 324 may be substantially equal or equal to the outer diameter of the sleeve 323 and housing 305 so that a diameter of an annulus 328*a* formed between the sleeve/housing and production tubing 15 may be substantially equal to a diameter of an annulus 328*b* formed between the anchor body 324 and the production tubing 15. The overall length of anchor body 324 may be equal to or substantially equal to the overall length of the sleeve/housing so that a volume of the annulus 328*a* may be equal to or substantially equal to a volume of the annulus 328*b*. The anchor 303 may further include a centralizer body 326 threadedly connected to the anchor body 324. A plurality of arms 327 may radially extend from the centralizer body 326 into engagement with an inner surface of the production tubing 15. Each of the arms may include a spring-loaded telescopic assembly.

In operation, RCT 300 may be lowered down into production tubing 15 with wireline 307 to the location where production tubing 15 is to be cut. Electric current may be passed from the surface of the earth through the wireline 307 to the squib 306, thereby igniting the loosely packed material 315 which in turn ignites the pellets 314. A pipe cutting flame is generated and directed radially against the production tubing 15. The pipe cutting flame is directed by conical head 317 into head and spindle passageways, and onto the diverter 322. Cover 323 may be propelled downwardly along the mandrel 316 as the pipe cutting flame generates sufficient pressure to act on the cover shoulder, thereby exposing the diverter 322 to the production tubing 15. The pipe cutting flame passes outwardly of the diverter and contacts and cuts, substantially cuts, or scores the production tubing 15.

Scoring the production tubing 15 rather than completely cutting the production tubing 15 may be beneficial to prevent damage to the casing 10. During the cutting or scoring procedure, residual gas may be produced and flow within the annuli 328*a, b*. As volumes of the annuli 328*a, b* may be equal or substantially equal, the resulting downward force of the gas above the diverter 322 may be equal or substantially equal to the upward force of gas below the diverter 322 thereby maintaining the RCT 300 in a stable condition within the production tubing 15.

In another embodiment, a slickline battery firing system may be employed in lieu of the electric line firing system to energize the igniter 301 so that slickline may be used to deploy the RCT 300 instead of wireline. This alternative may include a slickline cable head which is connected to a pressure firing head. The pressure firing head may include a metal piston having a larger diameter head with a smaller diameter metal rod extending downward from the bottom of the larger diameter head. The piston may be slidably located in a hollow cylinder. A spring surrounding the rod may be employed to provide upward pressure against the under side of the larger diameter head. The spring may be adjustable to allow for hydrostatic compensation of well fluids so that the system does not fire at bottom hole pressure. When the piston is moved downward the lower end of the rod will make contact with an electrical lead from the battery pack and an electrical lead coupled to one side of the igniter to discharge current to the igniter 301. Fluid ports may extend through the wall of the cylinder above the larger diameter piston head. When the modified RCT is in place, a pump at the surface may increase the fluid pressure in the production tubing, thereby moving the piston downward against the pressure of the spring to allow the rod to make electrical contact with the leads to energize the igniter. Alternatively, instead of a battery, a percussion cap may be used to ignite the material 315. The percussion cap may be operated by the piston.

Also a coiled tubing percussion firing system may be employed in lieu of the electric line firing system to ignite the charges material 315. This system may include coiled tubing for supporting the modified RCT connected to a connector subassembly which connects to a pressure firing head which may include a hollow cylinder which supports an interior piston by shear pins. The coiled tubing may be coupled to the interior of the cylinder at its upper end. A firing pin may extend from the lower end of the piston. When the apparatus is at the desired cutting depth, fluid pressure may be increased within the coiled tubing which shears the shear pins driving the firing pin into a percussion cap to ignite the material 315.

Alternative embodiments of the RCT are discussed in U.S. Pat. Nos. 4,598,769 and 6,971,449, which are hereby incorporated by reference in their entireties.

Alternatively, a jet cutter or chemical cutter may be used instead of the radial cutting torch. A jet cutter may include a circular shaped explosive charge that severs the tubular radially. A chemical cutter may include a chemical (e.g., Bromine Triflouride) that may be forced through a catalyst sub containing oil/steel wool mixture. The chemical may react with the oil and ignite the steel wool, thereby increasing the pressure in the tool. The increased pressure may then push the activated chemical through one or more radially displaced orifices which direct the activated chemical toward the inner diameter of the tubular to sever or score the tubular. Such a chemical cutter is disclosed in U.S. Pat. No. 4,250,960, which is hereby incorporated by reference in its entirety.

Alternatively, a motorized cutting tool (MCT) may be used instead of the RCT. A motorized cutting tool may include a pump in fluid communication with hydraulically extendable anchors and one or more hydraulically extendable blades and a motor for rotating the blades. Alternatively, the anchors may be extended by an electric motor. The MCT may be deployed into the production tubing via wireline. Electric current may be delivered to the MCT, thereby operating the pump to extend the anchors and the blade into engagement with the production tubing and the motor to rotate the blade until the production tubing has been scored or cut. The MCT may be used to cut the production tubing 15 without risk of damage to the casing 10. The MCT is discussed in more detail in U.S. patent application Ser. No. 12/132,699 , filed Jun. 4, 2008, which is herein incorporated by reference in its entirety.

Figure 4:
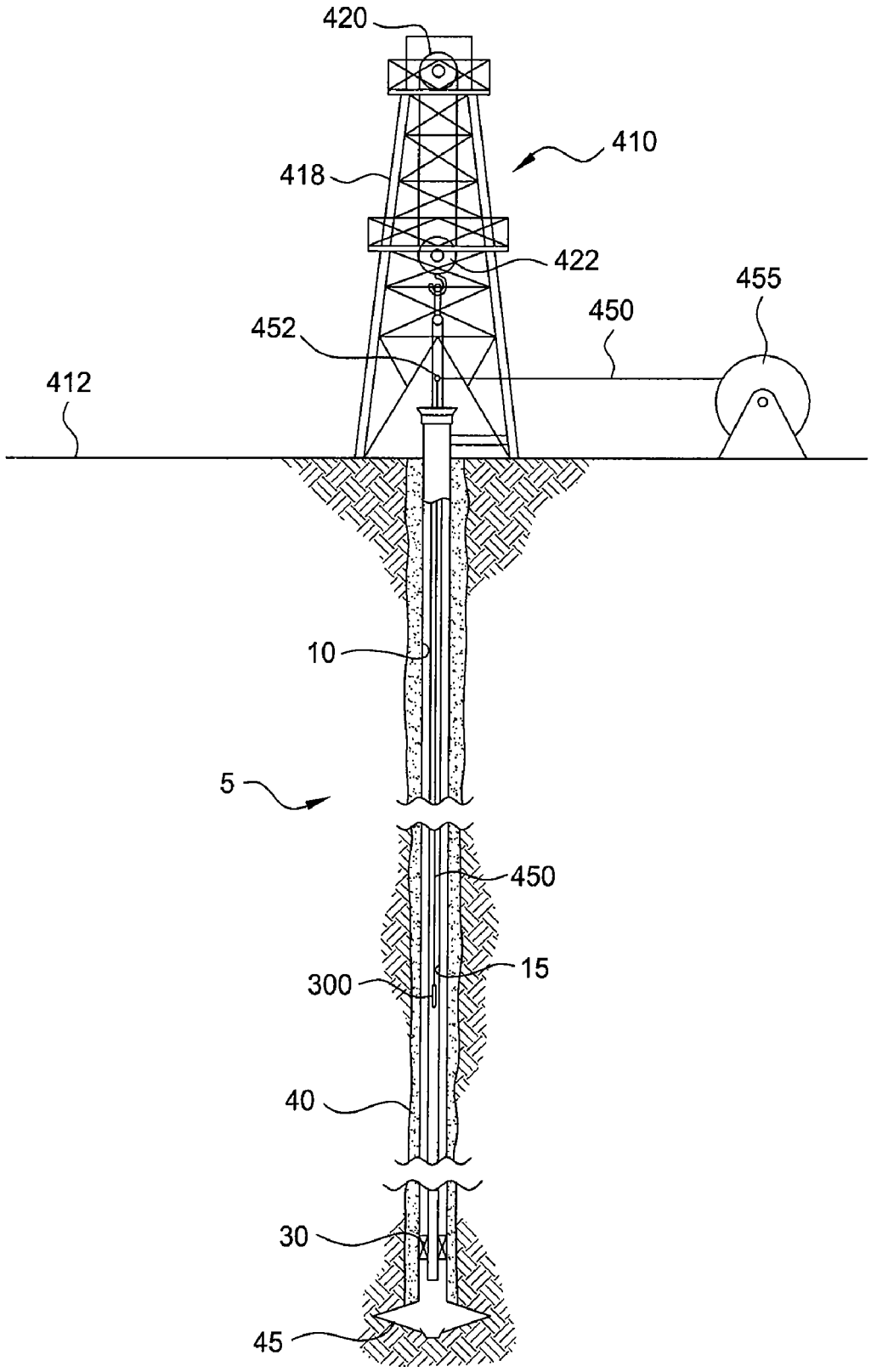
FIG. 4 illustrates a tubing cutting operation utilizing the line cutter mandrel, according to another embodiment of the present invention.
Figure 4A:
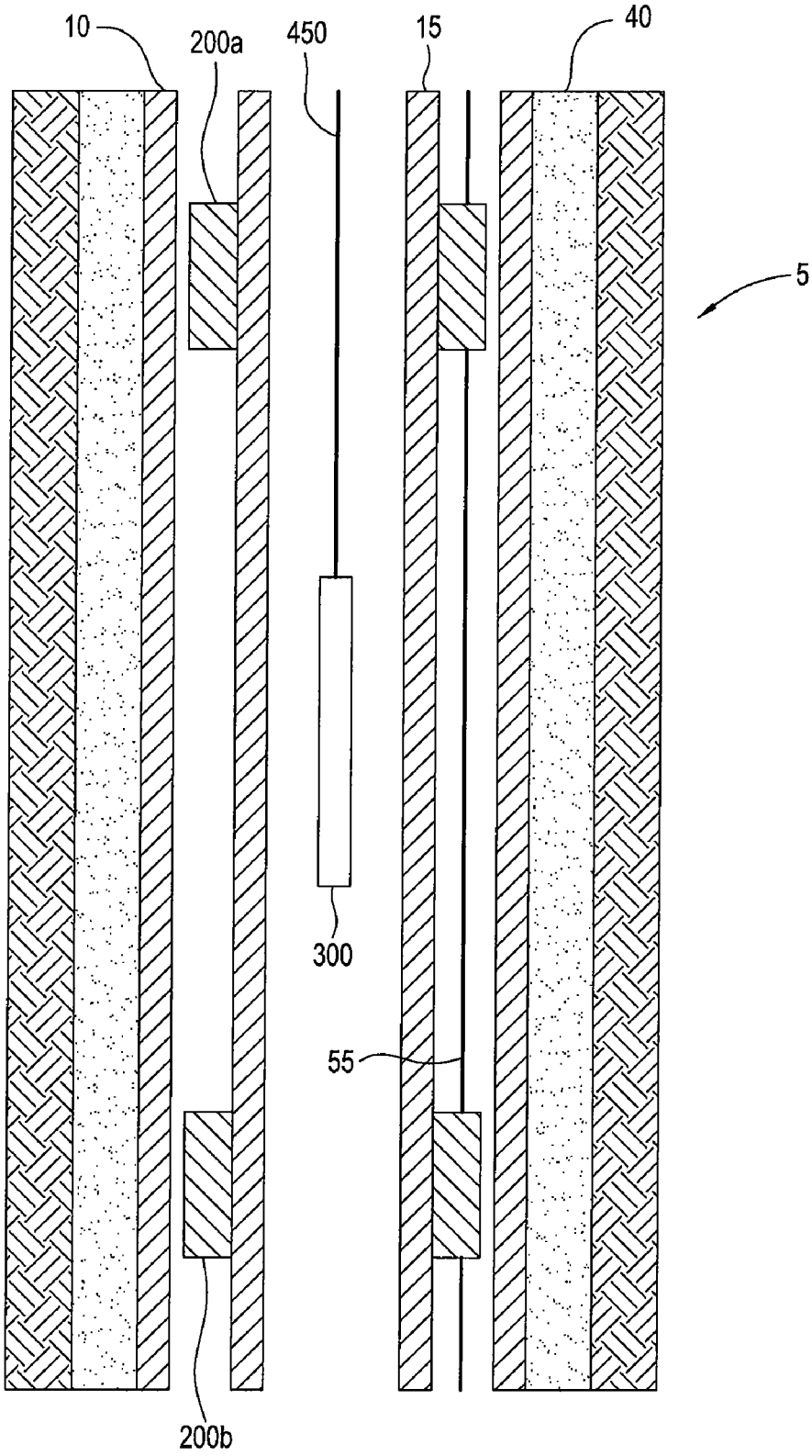
FIG. 4A is an enlargement of a portion of FIG. 4.

FIG. 4 illustrates a tubing cutting operation 400 utilizing the line cutter mandrel 200, according to another embodiment of the present invention. FIG. 4A is an enlargement of a portion of FIG. 4. A workover rig 410 may be disposed over an earth surface 412 proximate to the wellbore 5. The workover rig 410 may include draw works having a crown block 420 mounted in an upper end of a derrick 418. The draw works may also include a traveling block 422. The traveling block 422 may be connected to the upper end of the production tubing 15. Two line cutter mandrels 200*a, b* may have been assembled with the production tubing 15 during original deployment of the production tubing.

The RCT 300 may be deployed to the predetermined depth between the line cutter mandrels 200*a, b*. The RCT 300 may be run into the production tubing string 15 on a wireline 450. The RCT 300 and wireline 450 may be lowered into the production tubing string 415 by unspooling the line from a spool 455. The spool 455 may be brought to the wellbore 5 by a service truck (not shown). Unspooling of the line 450 into the wellbore 5 may be aided by sheave wheels 452. At the same time, the traveling block 422 may be used to suspend the production tubing string 415 so that the production tubing string may be in a neutral condition at the predetermined depth. Alternatively, the production tubing may still be supported from the wellhead during the cutting operation so that the production tubing string 15 may be neutral, in tension or compression at the predetermined depth.

Figure 4B:
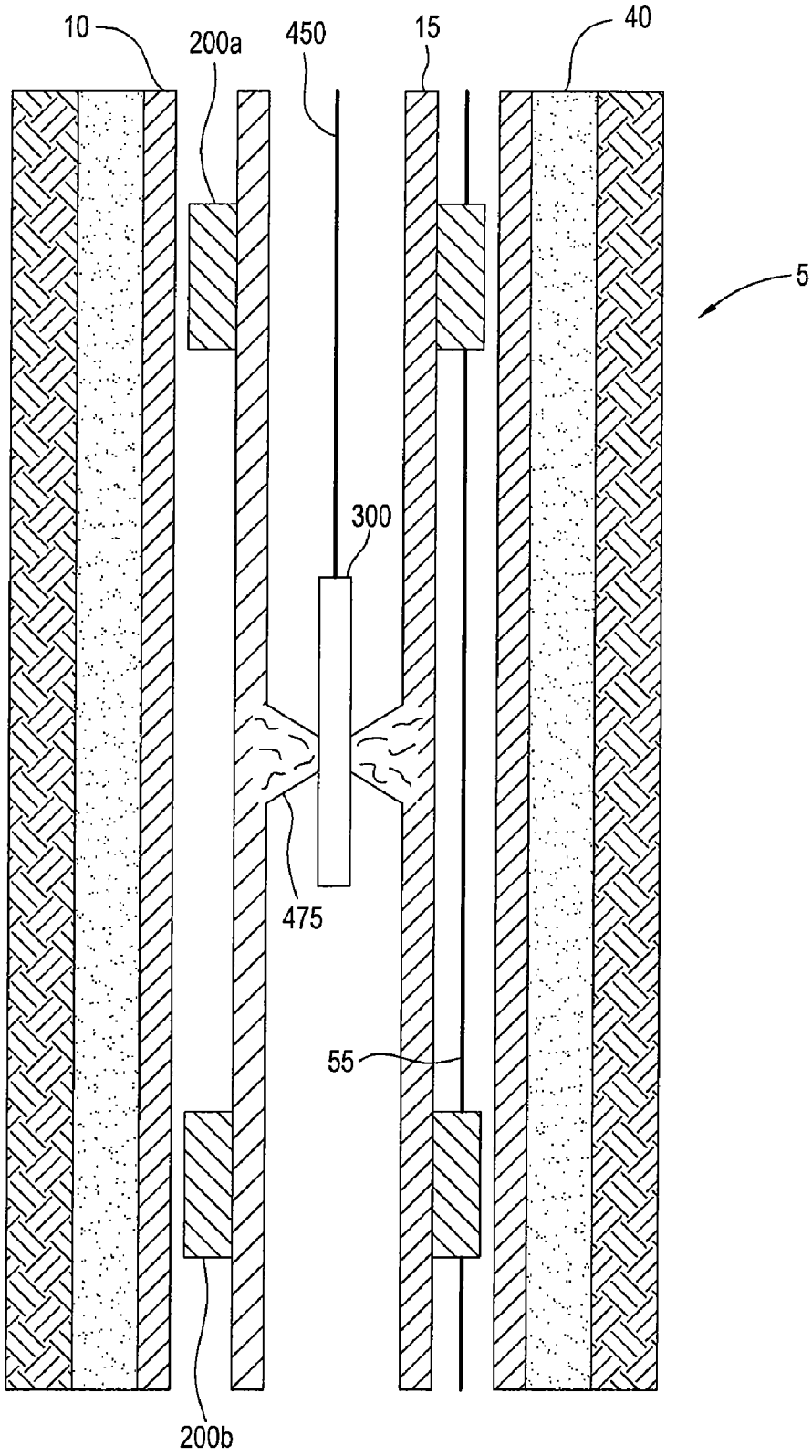
FIG. 4B illustrates the RCT scoring the production tubing.

FIG. 4B illustrates the RCT 300 scoring the production tubing. Once the RCT 300 has reached the predetermined depth in the production tubing 415, the RCT may be activated by supplying electricity from the surface to the RCT via the wireline 450. As discussed above, the RCT 300 may then generate pipe cutting flame 475, thereby scoring 480 or cutting the production tubing.

Figure 4C:
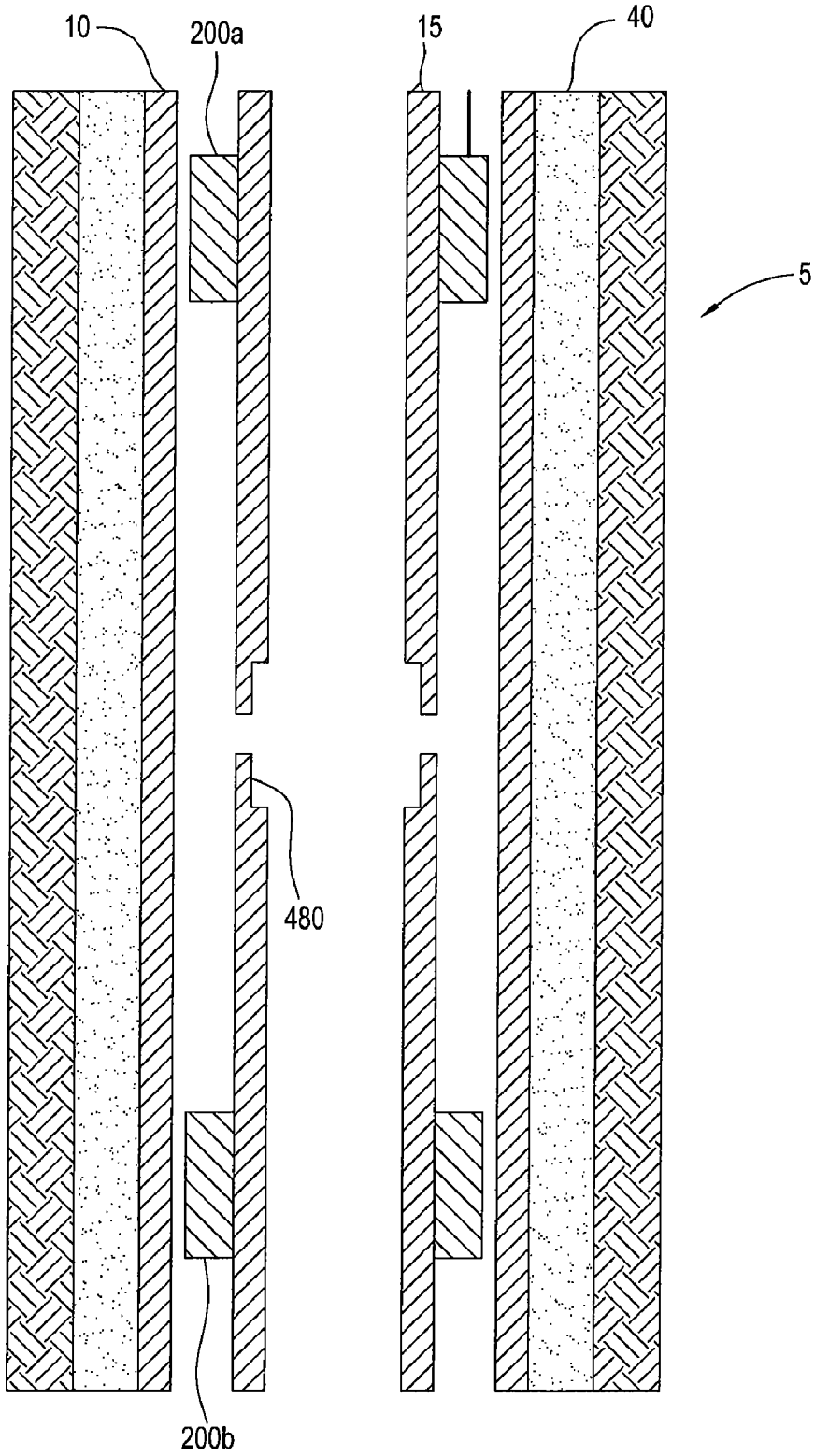
FIG. 4C illustrates retrieval of the production tubing to the surface and operation of the line cutter mandrels.

FIG. 4C illustrates retrieval of the production tubing to the surface 412 and operation of the line cutter mandrels 200*a, b*. Once the production tubing string 15 has been scored 480, the RCT 300 may be removed from the production tubing string 15. The workover rig 410 may then pull the production tubing string 15 so that the score 480 is placed in tension, thereby fracturing the score. The workover rig 410 may continue to pull on an upper portion of the production tubing string 15, thereby placing the cable 55 in tension and actuating the line cutter mandrels 200*a, b*. Once the line cutter mandrels 200*a, b* have cut the cable 55, the workover rig may continue to retrieve the upper portion of the production tubing string to the surface until the production tubing string has been tripped out of the wellbore. Use of the line cutter mandrels 200*a,b* ensures that that the upper end of the lower portion of the production tubing string is free from nested cable, thereby facilitating subsequent wellbore operations, such as fishing the lower portion of the production tubing string from the wellbore, recompleting the wellbore to a higher producing zone, or drilling a lateral wellbore above the lower portion of the production tubing string to another producing formation. The higher producing zone may be located at a depth above the predetermined depth.

While the foregoing is directed to embodiments of the present invention, other and further embodiments of the invention may be devised without departing from the basic scope thereof, and the scope thereof is determined by the claims that follow.

The invention claimed is:

1. A line cutter mandrel, comprising:
- a tubular mandrel;
- a pocket disposed along an outer surface of the mandrel and longitudinally coupled to the mandrel;
- a channel disposed through the pocket for receiving a cable; and
- a line cutter:
  - comprising a blade and a spring biasing the line cutter toward a gripping position,
  - operable to engage an outer surface of the cable in the gripping position,
  - operable to at least substantially sever the cable with the blade in a cutting position, and
  - operable from the gripping position to the cutting position by relative longitudinal movement between the cable and the pocket.

2. A line cutter mandrel comprising:
- a tubular mandrel;
- a pocket disposed along an outer surface of the mandrel and longitudinally coupled to the mandrel;
- a channel disposed through the pocket for receiving a cable; and
- a line cutter:
  - comprising a blade,
  - operable to engage an outer surface of the cable in the gripping position,
  - operable to at least substantially sever the cable with the blade in a cutting position, and
  - operable from the gripping position to the cutting position by relative longitudinal movement between the cable and the pocket, wherein the line cutter further comprises a first cam:
    - receiving the blade,
    - engaging the outer surface of the cable in the gripping position, and
    - having a curved engagement surface operable to continuously engage the cable between the positions.

3. The line cutter mandrel of claim 2, wherein the line cutter further comprises a second cam:
- receiving the blade,
- engaging the outer surface of the cable in the gripping position, and having a curved engagement surface operable to continuously engage the cable between the positions.

4. The line cutter mandrel of claim 1, further comprising a second line cutter:

comprising a blade, operable to engage an outer surface of the cable in a gripping position, operable to at least substantially sever the cable with the blade in a cutting position, and operable from the gripping position to the cutting position by relative longitudinal movement between the cable and the pocket, wherein the line cutters are disposed circumferentially around the pocket.

5. A method of cutting a production tubing string, comprising:

running a cutting tool into the production tubing string, wherein the production tubing string is disposed in a wellbore and comprises a line cutter mandrel;

operating the cutting tool, thereby at least scoring the production tubing string; and pulling on an upper portion of the production tubing string, thereby operating the line cutter mandrel and at least substantially severing a cable or hydraulic tubing extending along an outer surface of the production tubing string.

6. The method of claim 5, wherein:

the production tubing string further comprises a second line cutter mandrel or a line gripper mandrel, one of the mandrels is located above the scoring depth of the production tubing string, and one of the mandrels is located below the scoring depth.

7. The method of claim 5, wherein the line cutter mandrel is located in the production tubing proximate to the scoring depth of the production tubing string.

8. The method of claim 5, wherein:

the production tubing further comprises an instrumentation sub or valve, the cable or hydraulic tubing extends to the instrumentation sub or valve, and the line cutter mandrel is located in the production tubing proximately above the instrumentation sub or valve.

9. The method of claim 5, wherein the wellbore extends to a first producing zone below the production tubing string, and the method further comprises recompleting the wellbore to a second producing zone.

10. The method of claim 9, wherein the second producing zone is located above the scoring depth of the production tubing string.

11. The method of claim 5, further comprising drilling a lateral wellbore from the wellbore.

12. The method of claim 5, further comprising fishing a lower portion of the production tubing string from the wellbore.

13. The method of claim 5, wherein:

the cutting tool is a radial cutting torch, the production tubing is scored, and pulling on the upper portion of the production tubular string also fractures the score.

14. The method of claim 5, wherein the line cutter mandrel comprises:

a pocket disposed along an outer surface of the production tubing and longitudinally coupled to the production tubing;

a channel disposed through the pocket for receiving the cable or hydraulic tubing; and a line cutter:

comprising a blade, operable to engage an outer surface of the cable or hydraulic tubing in a gripping position, operable to at least substantially sever the cable or hydraulic tubing with the blade in a cutting position, and operable from the gripping position to the cutting position by relative longitudinal movement between the cable and the pocket.

15. The method of claim 14, wherein the line cutter further comprises a first cam:

receiving the blade, engaging the outer surface of the cable in the gripping position, and having a curved engagement surface operable to continuously engage the cable between the positions.

16. The method of claim 15, wherein the line cutter further comprises a second cam:

receiving the blade, engaging the outer surface of the cable in the gripping position, and having a curved engagement surface operable to continuously engage the cable between the positions.

17. The method of claim 14, wherein the line cutter further comprises a spring biasing the line cutter toward the gripping position.

18. The method of claim 14, further comprising a second line cutter:

comprising a blade, operable to engage an outer surface of the cable or hydraulic tubing in a gripping position, operable to at least substantially sever the cable or hydraulic tubing with the blade in a cutting position, and operable from the gripping position to the cutting position by relative longitudinal movement between the cable and the pocket, wherein the line cutters are disposed circumferentially around the pocket.

* * * * *